US010336407B2

(12) United States Patent
Kennedy

(10) Patent No.: US 10,336,407 B2
(45) Date of Patent: Jul. 2, 2019

(54) POOL FLOTATION TETHER ASSEMBLY

(71) Applicant: Heidi Kennedy, Mansfield, TX (US)

(72) Inventor: Heidi Kennedy, Mansfield, TX (US)

( * ) Notice: Subject to any disclaimer, the term of this patent is extended or adjusted under 35 U.S.C. 154(b) by 0 days.

(21) Appl. No.: 16/103,095

(22) Filed: Aug. 14, 2018

(65) Prior Publication Data

US 2019/0100286 A1 Apr. 4, 2019

Related U.S. Application Data

(63) Continuation-in-part of application No. 15/720,847, filed on Sep. 29, 2017, now abandoned.

(51) Int. Cl.

| | |
|---|---|
| ***B63B 21/20*** | (2006.01) |
| ***B63B 35/85*** | (2006.01) |
| *E04H 4/14* | (2006.01) |
| *A47G 23/02* | (2006.01) |

(52) U.S. Cl.

CPC ..... *B63B 21/20* (2013.01); *B63B 35/85* (2013.01); *A47G 23/02* (2013.01); *E04H 4/144* (2013.01)

(58) Field of Classification Search

CPC ..... B63B 22/24; B63B 35/73

See application file for complete search history.

(56) References Cited

U.S. PATENT DOCUMENTS 4,729,331 A * 3/1988 Eggleston ..... B63B 21/00 114/230.26
4,775,346 A * 10/1988 Gunter ..... A63B 67/007 114/293
4,834,015 A * 5/1989 Alpert ..... B63B 21/29 114/294
5,460,113 A * 10/1995 Gunter ..... B63B 21/00 114/230.2
5,476,404 A * 12/1995 Price ..... A47C 15/006 441/126
5,518,431 A * 5/1996 Staley ..... A47C 15/006 114/345
6,475,048 B2 * 11/2002 Gredy ..... B63B 21/00 114/230.1
6,805,066 B2 * 10/2004 Johnson ..... B63B 3/08 114/266
7,867,049 B1 * 1/2011 Doffay ..... B63B 35/58 114/345
8,790,148 B2 * 7/2014 Ehrat ..... B63B 35/85 441/129

(Continued)

OTHER PUBLICATIONS

Final Office Action in related U.S. Appl. No. 15/720,847, dated Jun. 12, 2018, 8 pages.

(Continued)

*Primary Examiner* — S. Joseph Morano
*Assistant Examiner* — Jovon E Hayes
(74) *Attorney, Agent, or Firm* — Law Office of Jeff Williams PLLC; J. Oliver Williams

(57) ABSTRACT

An assembly and method for the use of a float in a pool. The assembly provides a stable platform to place food, drink, and decorations. Additionally, the assembly reduces the number of small animals drowning or dying in a pool by providing a stable platform in which to climb onto to get out of the water. The assembly includes a foam float, tether, and anchor. The anchor and tether confine the area the float can travel. The anchor is attached to the pool wall, eliminating a tripping hazard next to the pool.

10 Claims, 3 Drawing Sheets

(56) References Cited

U.S. PATENT DOCUMENTS

| | | | | |
|---|---|---|---|---|
| 8,888,546 | B2 * | 11/2014 | Dykstra | B63B 21/00<br>441/129 |
| 9,139,263 | B2 * | 9/2015 | Rubey | B63B 35/74 |
| 9,302,749 | B1 * | 4/2016 | D'Offay | B63B 7/082 |

OTHER PUBLICATIONS

Non-Final Office Action in related U.S. Appl. No. 15/720,847, dated Feb. 28, 2018, 7 pages.

* cited by examiner

POOL FLOTATION TETHER ASSEMBLY

BACKGROUND

1. Field of the Invention

The present application relates to a pool float, and more particularly to an assembly used to secure a pool float to the pool with a tether.

2. Description of Related Art

The desire to keep animals from drowning in pools, to have somewhere to place food and drink, and to decorate the pool have been held by users since pools were first installed in backyards. Users want to minimize the costs associated with the upkeep of a pool while making the pool more functional and beautifying the back yard.

The costs associate with maintaining a pool is large, even when everything goes right. There is the cost for power and water, plus the chemicals to keep the water clean. An animal drowning in a pool adds extra costs. Pools, as large bodies of water, will naturally attract wild and domestic animals. These animals inevitably fall in the pool. The pool, with its vertical walls is difficult for many small animals to get out of. These animals tire and die. Additionally, animals that would not have a problem with swimming can be adversely affected by prolonged exposure to the chemicals found in the pool's water and also die. Dead animals in a pool can clog filters and inhibit the pool systems ability to keep the water clean. In extreme situations, the clogged filters can result in damage to the pool system. Dead animals in the pool can result in users getting ill and additional costs associated with trouble shooting and repair of the pool system. Although strides have been made to prevent small animals from drowning in pools, considerable short comings remain.

Pools are places were family and friends can gather together at and play. When people gather, there are usually food and drinks. Currently, pool users either must hold their food or drink while in the pool, or place it on the ground next to the pool or farther away. This limits the ability of the user to enjoy the pool while eating or drinking. Additionally, food and drink next to the pool creates a trip hazard and the food or drink could be accidentally kicked into the pool. Although strides have been made to provide pool users with places to keep food and drink near or in the pool, considerable short comings remain.

Typically, users like to decorate the back yard and make it more attractive. Pools are large and take up a lot of backyard space, limiting the amount of area available for decorations. Currently, users can use decorations in the pool that float, which limits the user's choices of decorations. The pool decorations are either unanchored or anchored. If they are unanchored, the decorations can be pushed into one area of the pool by the wind. If the decorations are tethered, usually the anchor is laid on the ground next to the pool and a weighted bag is placed over it. This creates a tripping hazard for user's walking around the pool. Although strides have been made to provide decorations for use in the pool, considerable short comings remain.

It is desirable for a user to prevent animals from drowning in the pool, provide a trip free place for food and drink to sit while family and friends are enjoying the pool, allow for the use of a wider array of decorations that can be used in the pool, and secure the position of those decorations in the pool without creating additional hazards.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
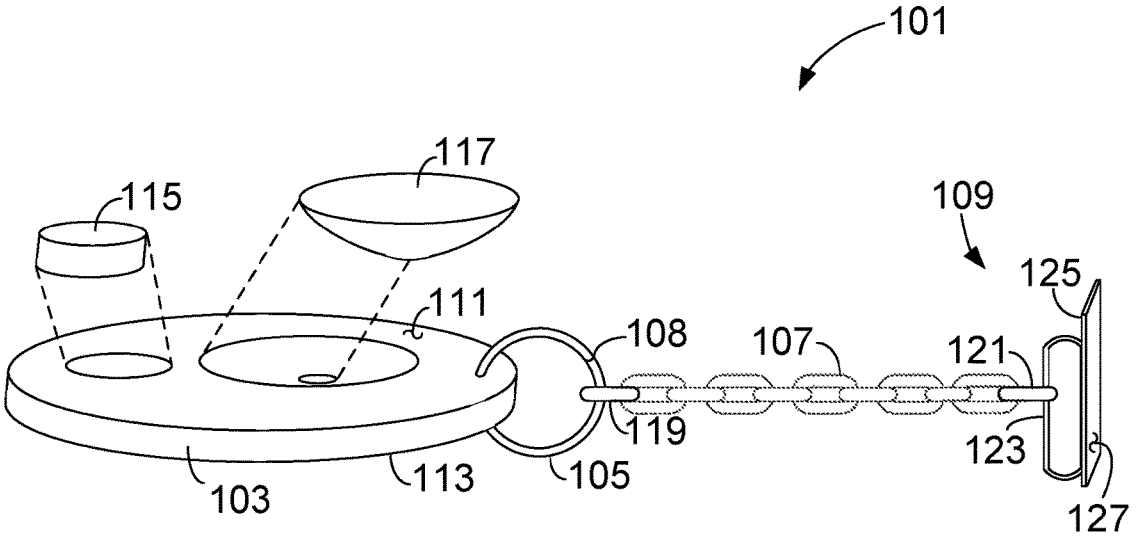
FIG. 1 is a partially exploded perspective view of a pool floatation tether assembly according to an embodiment of the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the assembly are depicted in the attached drawings. However, as will be recognized by those skilled in the art after a complete reading of the present application, the assembly, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the assembly described herein may be oriented in any desired direction.

The assembly and method in accordance with the present application overcomes one or more of the above-discussed problems commonly associated with traditional floatation devices for pools. In particular, the assembly is configured to provide a safe way for small animals to get out of the water to avoid death, a convenient place to put drinks and food, a way to float more decorations on the pool, and a way to anchor the float without creating a tripping hazard. It is configured to provide a tether that is either rigid or flexible depending on the situation. Additionally, the assembly is configured to have a staggered height, increasing from the outer perimeter inward. Furthermore, the assembly includes multiple foam materials using foams of different density. These and other unique features of the assembly are discussed below and illustrated in the accompanying drawings.

The assembly and method will be understood, both as to its structure and operation, from the accompanying drawings, taken in conjunction with the accompanying description. Several embodiments of the assembly may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The assembly and method of the present application is illustrated in the associated drawings. The assembly includes a foam float made of a plurality of foam density materials, an anchor, an attachment member, and a tether. The tether and attachment member connect the float to an anchor. The anchor is secured to the side of the pool wall. Additional features and functions of the device are illustrated and discussed below.

Referring now to the drawings wherein like reference characters identify corresponding or similar elements in form and function throughout the several views. FIG. 1 illustrates a partially exploded perspective view of pool flotation tether assembly 101 of the present application. The pool flotation tether assembly 101 comprises: a foam float 103, an attachment member 105, a tether 107, and an anchor 109. It is understood that assembly 101 will be constructed from materials commonly used for outdoor use and safe for use in a pool 50 (see FIG. 2).

Float 103 has a top surface 111 and a bottom surface 113. Float 103 is configured to stay afloat when placed on liquid water. When float 103 is placed in water, bottom surface 113 is configured to be in contact with the water and top surface 111 is configured to be in contact with air. Float 103 is configured to take a load on its top surface 111 and still stay afloat and not tip over. The load capacity of floats, while still staying afloat, depends on the floats size. It is understood that larger floats will be able to remain afloat with a larger load than smaller floats. In this embodiment, typically a single density foam material would constitute float 103. However, foam float 103 may include a plurality of layers of foam materials, each having different densities.

Top surface 111 includes at least a first cut-out 115. As illustrated, float 103 may also include a second cut-out 117. It is understood that float 103 may contain a plurality of cut-outs depending on the floats size. Cut-outs may be the same size and shape depending on the purpose of the cut-out. Each cut-out leaves a similarly shaped void space in float 103 which is used to hold or support a variety of objects, such as: cups, bottles, vases, bowls, plates, and pitchers. Here, first cut-out 115 and second cut-out 117 are different sizes, first cut-out 115 is for a cup 52 and second cut-out is for a plate 54. In other embodiments, first cut-out 115 and second cut-out 117 could be the same size. First cut out 115 and second cut-out extends from the top surface into a portion of the interior of float 103. It is understood that in some embodiments cut-outs can extend to a portion of the bottom surface 113, as depicted with second cut-out 117.

The attachment member 105 is in communication between the float 103 and a first end 119 of the tether 107. Attachment member 105 operates between an open and a closed orientation to capture a portion of the float 103 and the first end 119. Attachment member 105 is configured to open at location 108 to permit passage within its defined ring. Attachment 105 is configured to pass within a portion of float 103 and first end 119. It is understood that attachment member 105 may take the shape and form of a clamp, ring, carabiner, or any other item commonly used to selectively secure items together. Attachment 105 and tether 107 are shown to be separate pieces in selective communication with each other; it is understood that in other embodiments, attachment member 105 and tether 107 may be integrally coupled. It is understood that attachment member 106 and tether 107 are made from a non-rusting material.

The tether 107 restricts the area the float 103 may travel while on a body of liquid water, such as a pool. It is understood that tether 107 will come in different lengths to vary the amount of area float 103 can travel in. Tether 107 is illustrated as a type of linked chain, but it is understood that in other embodiments, tether 107 may be a rope, strap, wire, or any other similar type of material that is appropriate for use outside in a pool. Tether 107 further having a second end 121 which is located on a different end from first end 119. Second end 121 is in selective communication with a portion of anchor 109.

Figure 2:
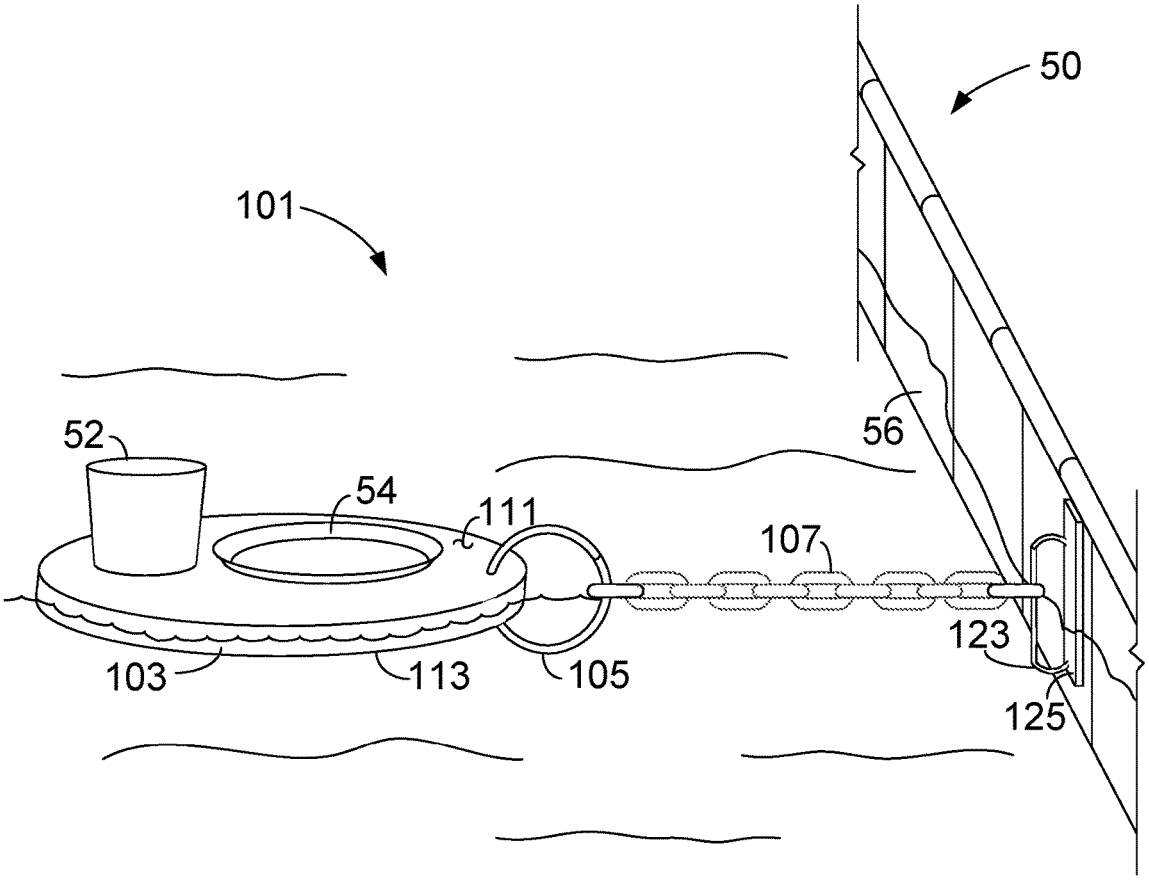
FIG. 2 is an additional perspective view of the pool floatation tether assembly of FIG. 1 in use.

Referring now also to FIG. 2, an additional perspective view of the pool floatation tether assembly 101 is illustrated while in use. The anchor 109 is a mooring point for float 103. Anchor 109 is secured to a pool wall 56 through a mechanical fastener, like a suction device, a threaded fastener, or an adhesive. It is understood that anchor 109 is configured to be detachable from pool wall 56. Anchor 109 is configured to be located above or below the water level of pool 50. Anchor 109 comprises a tether coupling 123 and a fastener 125.

Tether coupling 123 provides a point where second end 121 can be secured to. While tether coupling 123 is illustrated to pass through a portion of second end 121, it is understood that in other embodiments tether coupling 123 may be configured to allow for other types of mooring methods, including: wrapping and threading together.

Fastener 125 and tether coupling 123 can be configured to be either integrally coupled together or in selective communication each other. Integrally coupling fastener 125 and tether coupling 123 would create a stronger anchor point for tether 1207; while selective communication would allow the user to change the anchor point based on surrounding environment and the tether used. Fastener surface 127 is the portion of fastener 125 which communicates with pool wall 52. Fastener surface 127 and tether coupling 123 are located on different sides of fastener 125.

Figure 3:
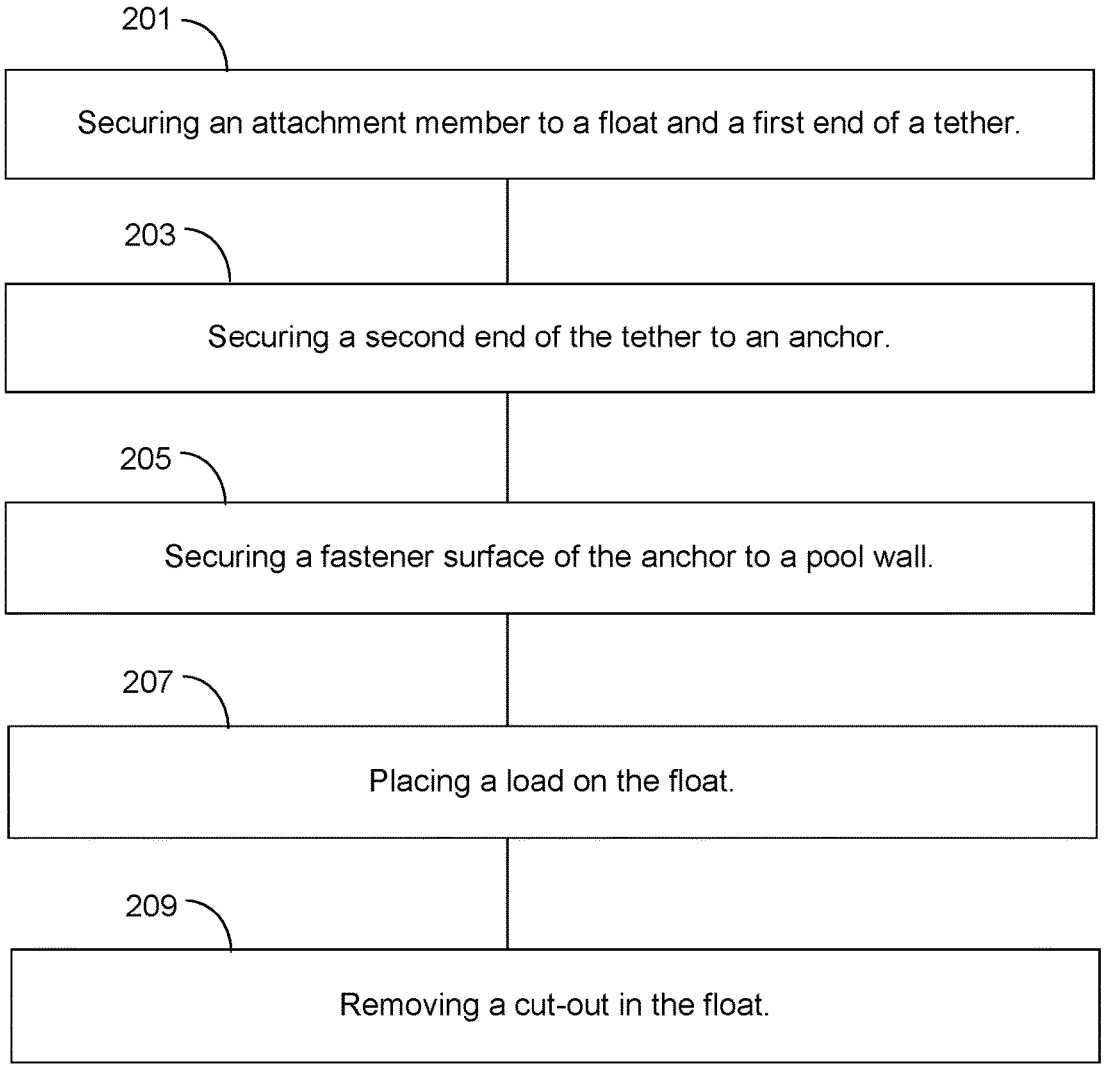
FIG. 3 is a flow chart for the use of the pool floatation tether assembly FIG. 1.

Referring now also to FIG. 3 demonstrating the method for use of the pool flotation tether assembly 101. A user assembles the pool flotation tether assembly by securing an attachment member to a float and a first end of a tether, step 201. In some configurations, the attachment member and tether are one piece and do not need to be connected by the user. The user then secures a second end of the tether to an anchor, step 203. The anchor having a tether coupling, which selectively communicates with the second end, and a fastener with a fastener surface. The fastener surface of the anchor is then secured to a pool wall, step 205. It is understood that the anchor, being located in the pool, is configured to properly function in and out of the pool water. It is understood that the user can perform steps 201, 203, and 205 in any order. The user then places the assembly in the pool and places a load on float, step 207. It is understood that the float is configured to stay afloat on water when a load is placed on it. The total allowable load depends on the configuration of the float. The user can remove a cut-out in the float, prior to placing the load, to better stabilize and support the load, step 209. When finished, the user can leave the assembly in the pool, or the user can detach the anchor from the pool wall.

Figure 4:
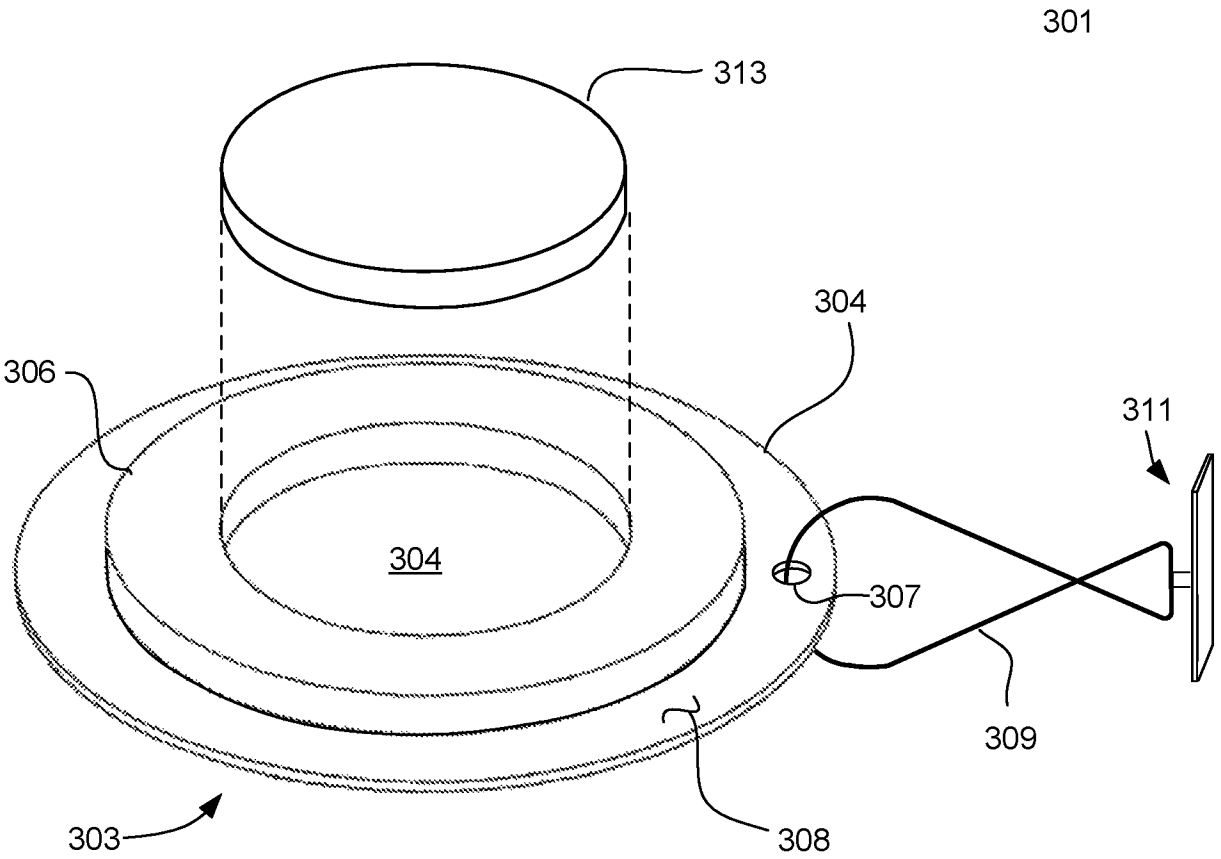
FIG. 4 is an alternate embodiment of the pool floatation tether assembly of FIG. 1.

Referring now also to FIG. 4 in the drawings, an alternative embodiment to assembly 101 is illustrated. Foam float assembly 301 is similar in form and function to that of assembly 101 except as herein noted. Whereas with float 103, one or more layers of foam material may be used and wherein each layer was sized similarly in diameter, assembly 301 is different. Assembly 301 includes a foam float 303 that is configured to float on the water. In float 303, multiple layers of foam material are used and sized independently to create an overall shape. Float 303 include lower layer 304 and upper layer 306. Each layer 304 and 306 are foam materials that have a different density between them. Lower layer 304 extends outward from the perimeter of upper layer 306 and is configured to maintain a smaller thickness adjacent the water line.

An advantage of float 303 is that its profile is thinnest around its periphery at the water's edge and then thickens toward the center or middle away from the perimeter. Examples of sizing that may be used with the layers is as follows. Lower layer 304 may be ¼ inch thick and 18 inches in diameter. Additionally, upper layer 306 may be 1 inch thick and only 14 inches in diameter. A persistent lip of lower layer 304 extends around upper layer 306.

An advantage of using lower layer 304 is found with animals that are in the pool. In some rural and suburban areas, natural wildlife sometimes find their way into the pool but fail to find an escape as the edges of the pool are vertical and quite a bit higher than the water level. Wildlife tire trying to escape and eventually drown. Assembly 301 is configured to assist wildlife in escaping the pool by providing adequate surfaces to grip onto, an easy access path, and a stable platform that floats on the water. Once atop the float, the animal may jump off to the side of the pool and escape.

The thickness of lower layer 304 allows for a minimal profile above the water level to assist in the animal pulling up onto surface 308. The animal may then climb up onto upper layer 306 and jump to safety. The density of lower layer 304 may be less than or greater than that of upper layer 306. Upper layer 306 is adhered to lower layer 304. Lower layer 304 extends fully underneath upper layer 306.

An aperture 307 is formed in lower layer 304 and is used to accept tether 309. Tether 309 passes through layer 304 and is secured to an anchor 311. Tether 309 is a rigid member that is configured to minimize flexure in the water. Tether 309 is a rigid bar attachment that increases friction at the joint with anchor 311. There is close tolerance between tether 309 and anchor 311 such that interference fit is permitted. This increase in friction forms a binding force that prevents the rotation and swivel of tether 309 about anchor 311. This extra rigidity helps to maintain a stable floating position in the pool for float 303. This in turn assists animals as a loose floating assembly works to continually push away from the animal and hinder their ability to lift themselves out of the water.

To assist in gripping the float 303, it was noted that float 303 is formed from a foam material, as opposed to an inflatable plastic. Inflatable devices require air tight materials that resist puncture and in turn prevent gripping by an animal. Additionally their air pressure tends to fluctuate. The inflatable devices lose air pressure and become mushy or flat making them unusable to act as a stable base upon which to stand. Float 303 is formed from a cell foam material that invites and accepts claws to grip into them. They maintain a constant shape and are stable in all weathers. Some advantage to the use of a foam multi density laminate float are: 1. Chemical and water resistance; 2. High strength to weight ratio; 3. Buoyant yet rigid; 4. Superb strength and tear resistance; 5. High shock absorption with flexibility; and 6. Impervious to mildew, mold, rot and bacteria. It is understood that other advantages exist beyond inflatable devices.

Assembly 301 maintains the optional ability to have a cut-out 313 similar to those with assembly 101. Cut-out 313 is found in upper layer 306 and passes all the way through upper layer 306. Cut-out 313 leaves a void space within upper layer 306 that is bounded by lower layer 304 at the bottom and by internal sides of upper layer 306. Various objects may be placed within cut-out 313 similarly to that of cut-outs 115 and 117.

The current application has many advantages over the prior art including at least the following: (1) the foam float is configured to take a load and not flip over, allowing small creatures to use the float to get out of the water without tipping the float over; (2) The floats stability, and cut-outs, provide a stable platform to hold food and drinks in the pool; (3) the floats stability and cut-outs also allow the user to use decorations not specifically designed for use in a pool; and (4) the use of an anchor that is attached to the wall of the pool eliminates a tripping hazard and relies upon interference fit to create a binding force to stabilize the position of the float on the water.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A pool floatation tether assembly, comprising:

a foam float having a lower layer and an upper layer, the lower layer and the upper layer being formed from a celled foam material, the foam density of the lower layer being different from the foam density of the upper layer, the float is configured so that a top surface of the lower layer remains above the surface of a body of liquid water, the lower layer extends beneath and outward around a periphery of the upper layer;

an anchor having a fastener, the fastener releasably secures the anchor to a wall in a pool; and a tether formed from a rigid member being coupled between the foam float and the anchor, the tether passing through the anchor under interference fit so as to create a binding force that minimizes movement of the foam float in the liquid water, the tether coupled to the lower layer outside the periphery of the upper layer; and a cut-out configured to act as a receptacle for an object, the cut-out configured to be cylindrical in shape and pass through the upper layer, the cut-out is bounded by a portion of the lower layer, the upper layer being thicker than the lower layer, the thickness of the lower layer within the cut-out being the same as the thickness of the lower layer extending around the periphery of the upper layer.

2. The assembly of claim 1, wherein the foam float carries a load on the top surface.

3. The assembly of claim 1, wherein the tether passes through the lower layer.

4. The assembly of claim 1, wherein the tether is made from a non-rusting material.

5. The assembly of claim 1, further comprising:

an attachment member in communication with the foam float, the attachment member inserted between the foam float and the tether.

6. The assembly of claim 5, wherein the attachment member and the tether are separate pieces in selective communication with each other.

7. The assembly of claim 5, wherein the attachment member operates between an open orientation and a closed orientation to capture a portion of at least one of the tether and the float.

8. The assembly of claim 5, wherein the attachment member is a clamp configured to pass within a portion of the float.

9. The assembly of claim 1, wherein the anchor is secured to a pool wall through a mechanical fastener.

10. The assembly of claim 1, wherein the anchor is secured to a pool wall through an adhesive.

* * * * *